US005383509A

United States Patent [19]

Gaffney et al.

[11] Patent Number: 5,383,509

[45] Date of Patent: Jan. 24, 1995

[54] KIT FOR DOOR REINFORCEMENT

[76] Inventors: Thomas W. Gaffney, 4911 Third Ave., NW.; Thomas E. Killen, 6950 Hunters Rd., both of Naples, Fla. 33999

[21] Appl. No.: 103,447

[22] Filed: Aug. 6, 1993

[51] Int. Cl.[6] ..... E05D 15/26

[52] U.S. Cl. ..... 160/209

[58] Field of Search ..... 160/201, 133, 209, 264, 160/181, 182; 49/449, 365, 464, 466; 52/71, 127.2, 291, 721

[56] References Cited

U.S. PATENT DOCUMENTS

| | | | |
|---|---|---|---|
| 1,271,347 | 7/1918 | Moffitt | 49/464 |
| 2,183,015 | 12/1939 | Foulds | 52/291 |
| 2,783,508 | 3/1957 | Keating et al. | 20/27 |
| 2,794,217 | 6/1957 | Croft | 20/40 |
| 2,827,960 | 3/1958 | Keating et al. | 160/368 |
| 2,966,212 | 12/1960 | Fimbel | 160/201 X |
| 3,424,223 | 1/1969 | Rosenblatt | 160/201 X |
| 3,443,625 | 5/1969 | Moser et al. | 160/181 |
| 3,516,474 | 6/1970 | Pemberton et al. | 160/209 |
| 3,572,002 | 3/1971 | Nichols | 52/127.2 X |
| 3,853,166 | 12/1974 | Wrono | 160/201 X |
| 4,872,634 | 10/1989 | Gillaspy et al. | 52/127.2 X |
| 4,934,439 | 6/1990 | Martin | 160/201 |

*Primary Examiner*—David M. Purol

*Attorney, Agent, or Firm*—Myron E. Click

[57] ABSTRACT

A kit, for use with a building having a sectional overhead door and at least one vertically disposed strut for reinforcing the door against wind damage, unauthorized entry and the like, enabling quick installation in and easy removal of the strut from a door reinforcing position. Structure is are provided for releasably securing the top of the strut to the building and the bottom of the strut of the floor. Further, structure is provided to releasably secure the hinges of the sectional door to the reinforcing strut by using members having a finger portion for insertion into the hollow pin joining the hinge leaves at the knuckles. Structure is also provided for releasably securing the top and bottom of the strut to the top and bottom of the door. Similarly, apparatus for reinforcing an overhead door with a strut and releasable securing structure is also disclosed.

28 Claims, 2 Drawing Sheets

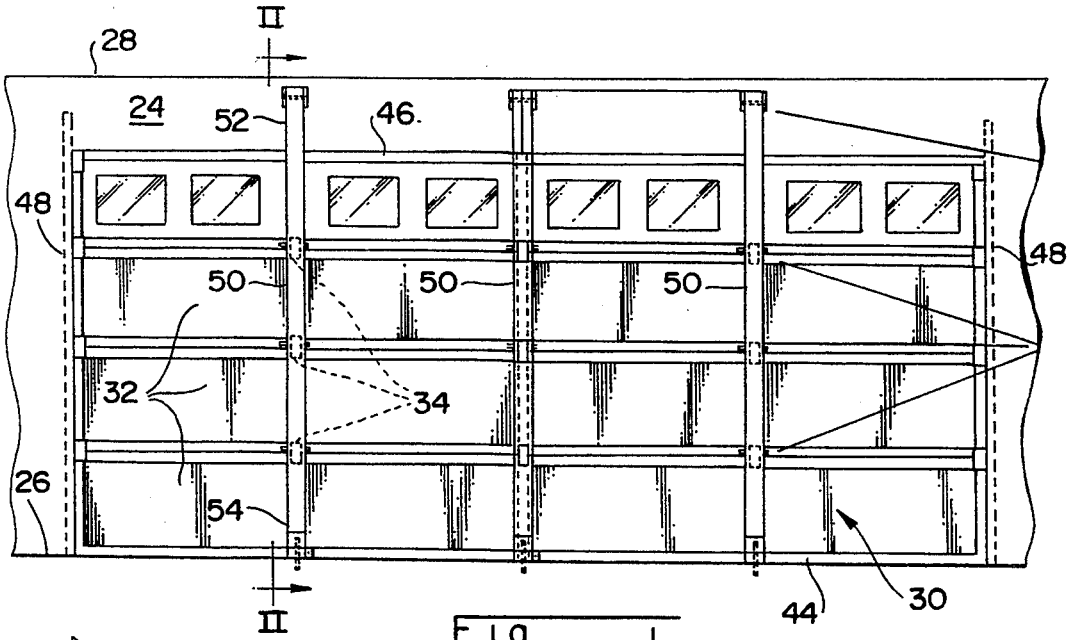
Fig- 1
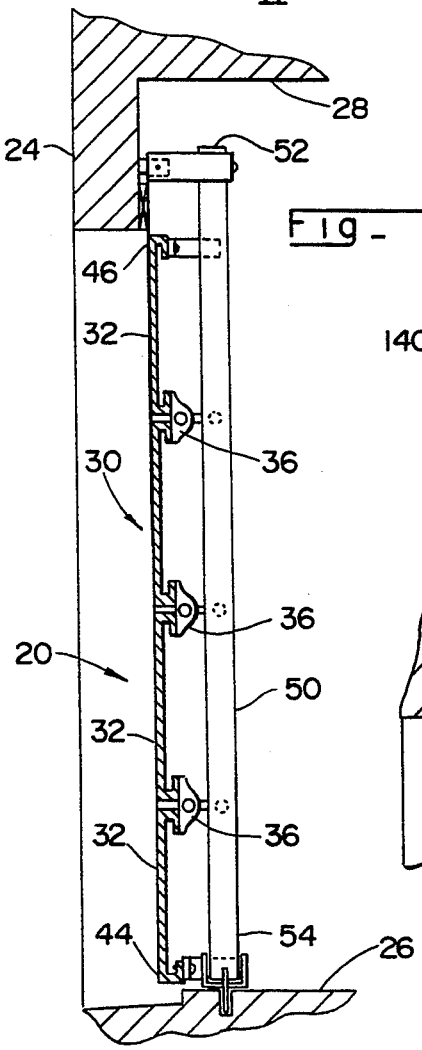
Fig- 2
Fig- 3
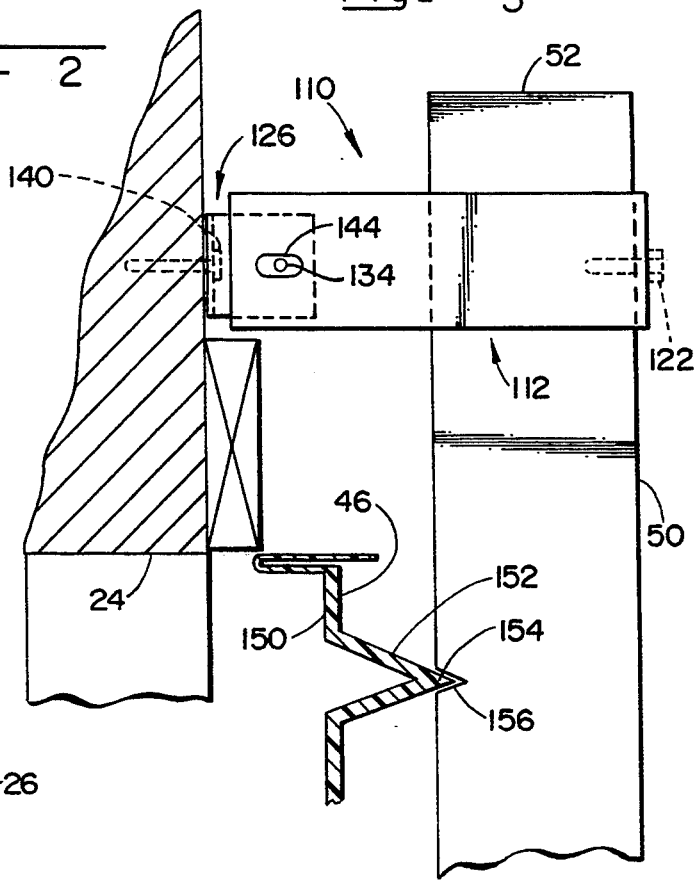

KIT FOR DOOR REINFORCEMENT

BACKGROUND OF THE INVENTION

1. Field of the Invention

This invention relates generally to reinforcing door structures and, in particular to reinforcing sectional overhead doors against wind damage, unauthorized entry and the like.

2. Description of the Prior Art

It is well known that storms, particularly of gale and hurricane force, cause tremendous amounts of damage to structures. Recent modifications to building codes have been directed to improving the ability of structures to withstand destructive wind forces.

Similarly, a great deal of attention has been directed to improving the security of structures against unauthorized entry.

In both instances, the role of attached or integral structures using sectional overhead doors have not received the same attention as the main building or main portion of a building which does not use overhead doors. However, the overhead door portion can usually be breached much more readily than the rest of the structure. In the case of a residence with an attached garage, the failure of the garage door allows wind forces to be applied internally to first lift off the garage roof, and then the residence roof may well follow, opening up the residence to further damage.

With respect to unauthorized entry, items of substantial value, such as automobiles, machinery or other equipment, are stored in garages. Further, entry into a garage area may enable easier access to the residence area. Therefore, residences are vulnerable, especially in areas where they are only occupied seasonally.

Recent efforts to resolve this problems have been made almost entirely in the area of strengthening the overhead door itself. While this is helpful, such efforts usually add substantial manufacturing costs to the door.

Further, these improvements usually also add to the weight of the doors, requiring adjustment to other door components and causing more difficulty in opening and closing because of the added mass.

As an example, horizontally disposed, individual rearwardly extending ribs have been added to the door panels to resist flexing of the panels. These ribs may be formed integrally with the door, as in foamed-in-place insulated doors. Also, the ribs may be added by the manufacturer after the panels are formed, or as a retrofit after the doors are installed, usually by bolting them on. The ribs reduce the overhead clearance of the doors, and really do not fully resolve the problems with the overhead doors.

U.S. Pat. No. 2,794,217 is directed to providing a hurricane brace for windows, which includes a rigid brace installed vertically in the window opening with a support extending toward and up against the window pane to prevent the glass from flexing inwardly. While this is helpful, having a function similar to the above-described panel ribs, not all damage is done simply by wind force directly against a window or a sectional door. Not all storm winds are so directed, and the wind direction usually varies—sometimes very quickly, and sometimes oscillating quickly between directions. As a result, the force on a door is not only inwardly, but also outwardly, because of the suctions or comparative vacuums generated by lift and drag effects similar to those forces on airfoil, etc. that are calculated by Bernoulli's equation. Therefore, support is needed for both inward and outward forces.

U.S. Pat. Nos. 2,783,508 and 2,827,960 are directed to reinforcing structures for barricades in door openings of box cars. However, these devices are directed only to opposing outward forces.

Accordingly, it is an object of this invention to provide an improved kit for use in and apparatus for reinforcing overhead sectional doors.

It is a further object of this invention to provide such kit and apparatus which reinforces such doors against both inward and outward pressures trying to breach the door.

It is a still further object of this invention to provide such kit and apparatus which reinforces such doors more economically than alternatives currently available.

Another object is to provide such kit and apparatus which may be used in both retro-fit and initial installation situations, such a kit and apparatus being quickly installed and enabling easy placement and removal when required.

Other objects, advantages and features of this invention will become apparent when the following description is taken in conjunction with the accompanying drawings.

SUMMARY OF THE INVENTION

A kit is disclosed for use with a building having a wall provided with a door opening defined by a door frame and a floor, a sectional overhead door installed in the opening for closing the door opening, and at least one vertically disposed strut having top and bottom ends and installed inside of and adjacent to the door for reinforcing the door. The door has a plurality of horizontally extending panels connected together by sets of vertically collinear hinges each having a hollow pin through knuckles thereof to join the leaves together. The vertically disposed struts are each aligned with a set of vertically collinear hinges on the door.

The kit comprises means for releasably securing a bottom end of a reinforcing strut to a floor in a fixed position inside of and adjacent to a sectional overhead door which closes a door opening. The kit further includes means for releasably securing a top end of a reinforcing strut in a fixed position to a building above the door.

To prevent or at least greatly reduce inward and outward movement of the door, means are provided for releasably securing at least part of a set of vertically collinear hinges, or other devices carried on the inside of the door and having openings formed therein, on the sectional overhead door to the reinforcing strut members and intermediate the ends thereof, which have a finger portion insertable into the hollow pin of the hinge or opening of a device and means for connecting the finger portion to the aligned strut. The member with a finger portion preferably includes a second finger portion connected to the first-mentioned finger portion. The second finger portion is insertable into a bore formed in the reinforcing strut to receive the second finger portion.

The kit also includes means for releasably securing the top and bottom ends of the overhead door to the reinforcing strut or struts.

The means for releasably securing the bottom of the reinforcing strut to the floor may include a pin for connection to and extension downwardly from the bottom of the vertically disposed struts. The pin has a length which allows the pin to extend from the bottom end of the strut enabling insertion of the pin into a bore formed in the floor to receive the pin. The kit preferably further includes a sleeve for insertion in the bore formed in the floor to receive the pin extending from the bottom of the vertically disposed struts, whereby the integrity and dimensions of the floor bore are maintained for repeated insertions and withdrawals of the pin.

The means for releasably securing the bottom of the struts to the floor advantageously includes a U-shaped bracket, having upwardly extending sides and a bottom portion connecting said sides, which conforms to and receives the bottom of a strut. The bottom of the U-shaped bracket is preferably formed to abut the front and rear of the pin. The upwardly extending sides of the U-bracket are positioned at the front and rear sides of a strut to receive back and forth pressures applied to the strut by the door.

The kit preferably includes means for securing the U-shaped bracket and the pin to the strut, whereby the bracket and pin stay on the strut when the strut is removed from the reinforcement position for storage.

As noted above the bottom of the door may be releasably secured to the bottom of the strut. A bracket having an L-shaped portion has one leg which is to be secured to the bottom of the strut, and another leg to be secured to the bottom of the door.

The means for releasably securing the top end of the strut to the top of the door may also be a bracket having an L-shaped portion, with one leg of the "L" to be secured to the top end of the strut while the other leg is to be secured to the top of the door, the structure being identical to that shown for the bottom of the door.

The means for releasably securing the top end of a strut to the building, or a header over the door opening which is part of the building, may include first and second brackets. The first bracket preferably includes a strap portion with two ends with one end to be secured to the top end of the strut and the other end extending toward the building above the door. The second bracket preferably has an L-shaped portion with one leg of the "L" to be secured to the building above the door and the other leg extending toward and in a parallel-adjacent relationship with the other end of the strap portion of the first bracket. The other end of the first bracket and the other leg of the second bracket preferably have coinciding apertures formed therein to enable them to be releasably secured together, e.g. by a nut and bolt combination.

Instead of having a strap portion only, as in the first bracket as just-described, the first bracket may advantageously be a U-shaped strap bracket having two sides and a side connector portion forming a "U" to be secured to the strut. The "U" surrounds the sides of the strut with the "U" opening toward the building above the door. A second U-shaped bracket is to be secured to the building with the "U" opening toward the strut and in a position in which the sides of the two U-shapes intermesh. The intermeshed sides preferably have coinciding apertures formed therein to enable the intermeshed sides to be fastened together.

As noted above, one or more panels of the door may have one or more horizontally disposed ribs carried on the inside of the door and extending rearwardly toward the interior of the building.

When the panels have such rib formation it is advantageous to provide means for selectively adjusting the distance between the reinforcement strut and the rib or ribs so that the strut butts up against the ribs to prevent inward flexing or movement of the door.

The invention also discloses apparatus for reinforcing sectional overhead doors which includes the reinforcing struts, posts or components properly connected to the kit elements as set forth above.

BRIEF DESCRIPTION OF THE DRAWINGS

In the drawings, where like numerals are employed to designate like parts throughout:

FIG. 1 is an elevational view of a sectional overhead door illustrating the layout and positions of the components of this invention.

FIG. 2 is a cross-sectional view of the door of FIG. 1, again illustrating the layout and position of components of this invention;

FIG. 3 is an enlarged side view of means for releasably securing the top of a reinforcement strut to the building;

BRIEF DESCRIPTION OF THE PREFERRED EMBODIMENTS

Figure 5:
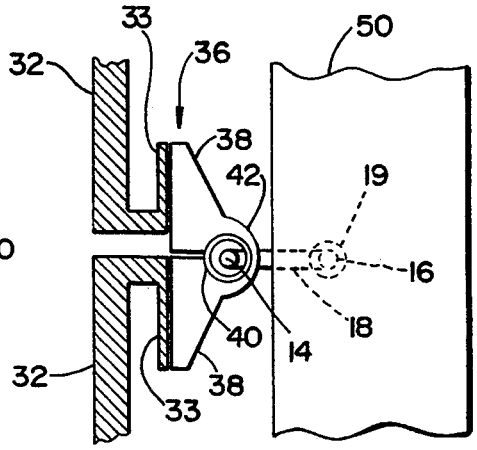
FIG. 5 is a side elevational view of means for releasably securing door hinges to a reinforcement strut.

Referring now to FIGS. 1 and 2, there is illustrated a sectional overhead door 30 installed to close a door opening 20 in a wall of a building. The opening 20 is defined by a door frame 22, a header portion 24 of the building, and a floor 26. A ceiling 28 is shown above the door 30 and the header 24. The door 30 has a plurality of horizontally extending panels 32 connected together by sets 34 of vertically collinear hinges 36. As shown in FIG. 5, each hinge 36 has a hollow pin 40 through the knuckles 42 thereof to join the two leaves 38 together. While such hinges are standard on most overhead doors, if such hinges are not used then devices carried on the inside of such a door may be used if they have openings formed therein to receive connecting fingers as discussed below. Vertically disposed reinforcing components, struts or posts 50 are each aligned with a set 34 of hinges or devices 36. Each strut has a top end 32 and a bottom end 54.

Means 110 for releasably securing the top end 32 of a post 50 are shown in FIG. 3. While there are alternatives for releasable securing the top, bottom and mid-portion of a strut to the door; the components shown are preferred because after initial installation the struts are intended to be easily removed. Further, when there is a need for reinforcement, the struts or posts are to be easily and quickly replaced in reinforcing position.

Figure 11:
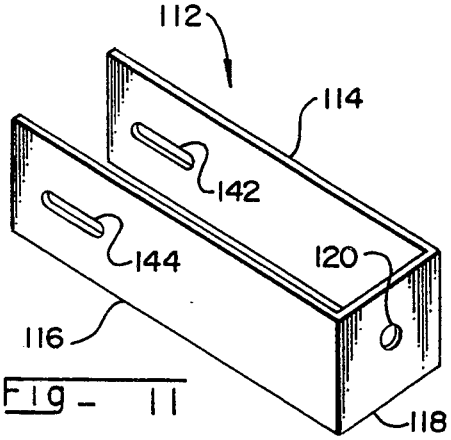
FIG. 11 is a view in perspective of a U-shaped bracket also used in FIG. 3.

In FIG. 3, a first U-shaped bracket 112 (shown separately in FIG. 11) has legs or sides 114, 116 of the "U" joined by bottom connector 118. Because the elongated legs 114, 115 extend beyond the strut 50 such brackets are sometimes called strap brackets, and the sides or legs 114, 116 are called strap portions. A lag screw aperture 120 is formed in connector portion 118. The bracket 112 is secured to post 50 by a lag screw 122.

Figure 10:
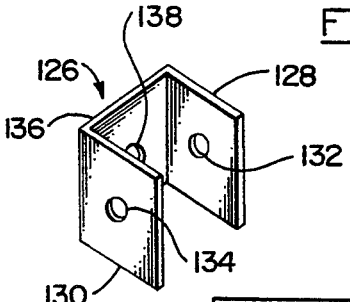
FIG. 10 is a view in perspective of a U-shaped bracket used in FIG. 3.

A second U-shaped bracket 126 (shown separately in FIG. 10), has legs or sides 128, 130 of the "U" joined by bottom connector 136. An aperture 138 enables securing bracket 126 to the header 24 or building by a lag screw 140, or a screw/anchor arrangement if the header is a concrete tie beam.

The strap bracket 112 has the "U" surrounding strut 50 and opening toward the buildings. The second bracket 126 is secured to the building with the "U" opening toward strut 50, and in a position in which the sides or legs of the two U-shapes intermesh. The intermeshed sides have coinciding apertures, 142, 144 of bracket 112 and 132, 134 of bracket 126, to enable the intermeshed sides to be fastened together by bolts and nuts or the like.

Figure 4:
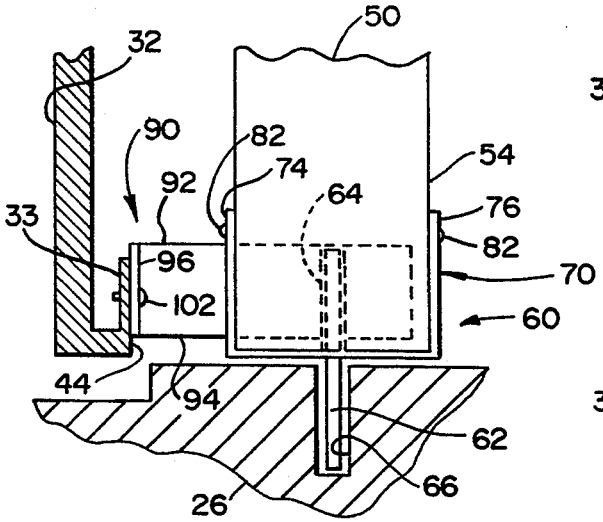
FIG. 4 is a side elevational view of means for releasably securing the bottom of a reinforcement strut to a floor.

At least one of each coinciding pair of apertures may be formed as a slot, e.g. apertures 142, 144. This provides a means for selectively adjusting the distance between the reinforcement strut and rib means formed on or attached to the door, e.g. at 152 in FIG. 3. This enables the strut 50 to be positioned in an abutting relationship with ribs which are horizontally disposed across the panels 32 and extend rearwardly therefrom to stiffen panels and reduce flexing thereof. The struts 50 may have a notch or other cavity 156 formed therein to receive an edge 154 of the ribs for further stability. Doors with such ribs at the top and bottom may not have a panel edge that is suitable for attachment to the strut as shown in FIG. 4, where a bracket 90 is used to restrain movement of a door edge. In such a case, the bracket 90 may be connected directly to a panel 32.

While the bracket 112 has a preferred U-shape for strength and ease of assembly, simple strap brackets which correspond to the sides or legs 114, 116 of bracket 112 may be used and secured to the side of strut 50. An L-shaped bracket which corresponds to one leg 114 plus the connector portion 118 may also be used. In each such embodiment, the bracket 126 may be used as shown if two strap brackets are used, or may be modified to an L-shaped bracket if an L-shaped bracket extends from strut 50.

Figure 6:
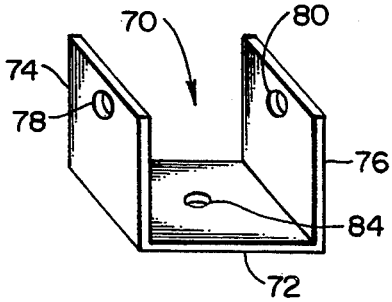
FIG. 6 is a view in perspective of a U-shaped bracket used in the means shown in FIG. 4.
Figure 7:
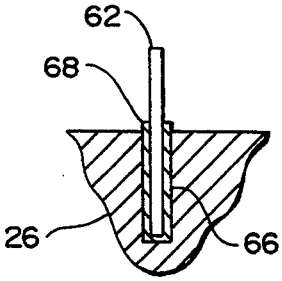
FIG. 7 is a side elevational view of a pin used in the means of FIG. 4 in place in a floor bore.

Means for releasably securing the bottom end 54 of a strut 50 are shown in FIG. 4. A vertically disposed pin 62 (shown separately in FIG. 7) is provided for connection to and extension downwardly from the bottom 54 of the strut 50. In FIG. 4 a vertical bore 64 may be formed in the bottom 54 of strut 50 and sized to enable a press fit of pin 62 in bore 64, as by tapping the pin into the bore with a hammer. The pin 62 may also be connected to strut 50 by welding or otherwise securing the pin to the bottom of the U-shaped bracket 70 (shown separately in FIG. 6). In this latter instance, the pin would have to be only half the length shown, as no bore 64 would need to be formed in strut 50. The bottom half of pin 62 is received by a bore 66 formed in floor 26, which maintains the bottom of strut 50 in a desired position. It is advantageous to use a sleeve 68 for insertion into the bore 66 formed in the floor to receive pin 62. This enables the integrity and dimension of the floor bore 66 to be maintained for repeated insertions and withdrawals of the pin 62.

The means for releasably securing the bottom of a strut to a floor in a fixed position further includes the U-shaped bracket 70 which conforms to and receives the bottom end 54 of strut 50. The bracket 70 (best seen in FIG. 6) includes a front upwardly extending side or leg 74 and a rear upwardly extending side or leg 76, joined by a bottom portion 72.

The bracket is positioned on strut 50 with the front side 14 adjacent the door and the rear side 76 away from the door to receive back and forth pressures applied to the strut 50 by door 30.

An aperture 84 may be formed in bottom portion 72 to accommodate the extension of pin 62 therethrough. As noted hereinbefore, the bracket and pin combination may be a one piece component, with only the lower half of the pin being used, which is connected to the bottom portion 72 by welding, etc. If the entire pin is used, the aperture 84 is preferably sized to provide an abutting relationship between the pin and the bottom portion 72 to transfer forces on the strut directly to the pin 62. The pin 62 and bracket 70 are preferably permanently secured to strut 50 to stay on the strut when it is removed from reinforcement position for storage.

Means indicated generally at 90 are also illustrated in FIG. 4 for releasably securing the bottom 54 of strut 50 to the door 30. This is also applicable to securing the top of the door to the top of the strut, using the same components shown in FIG. 4, so will not be repeated in another illustration.

Figure 8:
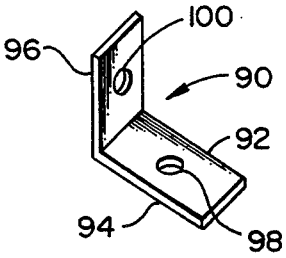
FIG. 8 is a view in perspective of an L-shaped bracket for securing the bottom of the door to the strut.

An L-shaped bracket 92 (best seen in FIG. 8) has one leg 94 of the "L" secured to the bottom of strut 50, with the other leg 96 to be releasably secured to a U-shaped edge 33 of a door panel 32. A lag screw aperture 98 in leg 94 accommodates a lag screw for securing leg 94 to strut 50. A bolt aperture 100 in leg 96 accommodates a bolt/nut combination 102 for releasably securing leg 96 to panel edge 33. An identical L-shaped bracket 92 may be used to releasably secure a top end of a strut to a top end or edge of a door in the same manner.

Referring now to FIG. 5, there is illustrated means for releasably securing at least part of a set 34 of vertically collinear hinges 36, or alternate devices described hereinbefore, on the sectional overhead door 30 to the reinforcing strut 50 aligned therewith. Standard hinges 36 for overhead doors have two leaves 58 joined together by a hollow pin 40 through the knuckles 42 on the leaves.

Figure 9:
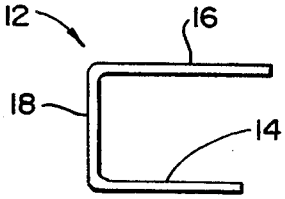
FIG. 9 is a side elevational view of a shackle member for securing the strut to the hinges as shown in FIG. 5.

A securing member (best seen in FIG. 9) is in a U-shaped shackle form 12 with a first finger portion 14 insertable into the hollow pin 40 of hinge 36, and means for connecting the first finger portion 14 to the aligned strut 50. In the preferred embodiment of this invention the member 12 further includes a second finger portion 16 connected to the first mentioned finger portion 14 by a U-connector portion 18. The second finger is insertable into a bore 19 formed in strut 50 to receive the second finger. Connection of the hinge to the door in effect also connects each of the panels having a leaf of the hinge secured thereto to the strut or post 50.

The reinforcing component, post or strut may be manufactured from any material capable of withstanding forces to be applied to the door. However, tests have shown that a common 4" by 6" pine wood post with the 4" edge parallel to the door will withstand wind speeds in excess of 165 miles per hour, far exceeding Hurricane force 5 winds. Moreover, such pine posts are relatively inexpensive, easy to obtain, and work well for bore formation and lag screw reception and holding power.

Since the construction and installation of sectional overhead doors is well known in the prior art such details are not included in this description. For example, rollers carried by panels (not shown) are placed in roller tracks 48 outlined in phantom lines at the vertical outside edges of the door. The quality and proper installation of the door are important. Although the struts will not fail under duress, a poor quality door or an improperly installed door may have panels or portions that will peel away.

One may use as many struts and fastening means as required for anticipated wind speeds. In hurricane prone areas one strut will would probably be adequate for an eight foot wide, well constructed door. However, a sixteen foot wide door may use three struts as shown in FIG. 1. Similarly, the number of finger components to connect the hinges to a strut can be varied, with maximum strength being obtained if each hinge or device of a set is connected to the aligned strut. Further, using the means to releasably secure the door edges to the strut or struts will further strengthen the door.

There has been described a kit and apparatus that is much less expensive than other alternatives. The kit enables easy installation of the reinforcing struts, and provides for quick removal of the struts for storage and replacement of the struts when required.

While the choice of the specific components and their arrangement in the preferred embodiments described herein illustrate the results and advantages obtained by those specific components over the prior art, the invention is not limited to those components and their arrangement. Thus, the forms of the invention shown and described herein are to be taken as illustrative, and changes in the components or their arrangement may be made without departing from the spirit and scope of this invention. There has been disclosed a kit and apparatus which differs from, provides functions not performed by, and has clear advantages over the prior art.

We claim:

1. Apparatus for reinforcing sectional overhead doors against wind damage, unauthorized entry and the like, when such a door is installed in a building having a floor and a wall with an opening therein to be closed by such a door, and when such a door carries one or more devices the inside thereof having openings formed therein such as hinges with hollow pins in the knuckles thereof, comprising;

(a) at least one elongated removably securable reinforcement component having top and bottom ends, said component being adapted for substantially vertical disposition on the inside of and adjacent to a closed sectional overhead door, (b) means for releasably securing said bottom end of said component in a fixed position to a floor inside of and adjacent to such a closed door to prevent inward movement of a closed door, (c) means for releasably securing said top end of said reinforcement component in a fixed position to a building having such a closed door to prevent inward movement of such a closed door, and (d) means for releasably securing said reinforcement component intermediate said top and bottom ends thereof to such a closed door, including a member adapted to be connected to said reinforcement component and which has a finger portion adapted to be inserted into an opening of a device carried on the inside of such a closed door to restrict movement of such a door outwardly.

2. Apparatus as defined in claim 1 in which said member adapted to be connected to said reinforcement component comprises a U-shaped member having a first leg which is said first-mentioned finger portion insertable into an opening of a device carried on such a door and a second leg which is formed as a second finger portion adapted to be inserted into a bore formed in said reinforcement component to receive said second finger portion.

3. Apparatus as defined in claim 2 which includes a plurality of said U-shaped members to releasably secure said reinforcement component to a plurality of such devices carried on such a door.

4. Apparatus as defined in claim 1 which further includes means for releasably securing said bottom end of said reinforcement component to a bottom of such a door to prevent both inward and outward movement of such a door.

5. Apparatus as defined in claim 1 which further includes means for releasably securing said top end of said reinforcement component to a top of such a door to prevent both inward and outward movement of such a door.

6. Apparatus as defined in claim 1 in which said means for releasably securing said bottom end of said reinforcement component to a floor includes a pin connected to said bottom end of said reinforcement component, said pin extending downwardly from said component enabling insertion thereof into a bore formed in a floor to receive said pin.

7. Apparatus as defined in claim 6 which further includes a sleeve for insertion into a bore formed in a floor to receive said pin extending from said bottom end of said reinforcement component, whereby the integrity and dimensions of a floor bore are maintained for repeated insertions and withdrawals of said pin.

8. Apparatus as defined in claim 6 which further includes a U-shaped bracket having upwardly extending sides and a bottom portion connecting said sides shaped to conform to and receive said bottom of said reinforcement component, said bottom portion of said U-shaped bracket being in an abutting relationship with said pin extending downwardly from said component, said reinforcement component having a front side facing such a door and a rear side opposite to said front side, said upwardly extending sides of said U-shaped bracket being positioned at said front side and said rear side of said reinforcement component to receive back and forth pressures applied to said component by such a door.

9. Apparatus as defined in claim 8 which further includes means for securing said U-shaped bracket and said pin to said bottom end of said reinforcement component, whereby said U-shaped bracket and said pin stay on said component when said component is removed from such a door for storage.

10. Apparatus as defined in claim 4 in which said means for releasably securing said bottom of said reinforcement component to a bottom of such a door includes a bracket having an L-shaped portion with first and second legs forming an "L", one leg of said "L" being secured to said bottom of said component, while the other leg of said "L" is to be secured to a bottom of such a door.

11. Apparatus as defined in claim 5 in which said means for releasably securing said top end of said reinforcement component to a top of such a door includes a bracket having an L-shaped portion with first and second legs forming an "L", one leg of said "L" being secured to said top end of said component while the other leg of said "L" is to be secured to a top of such a door.

12. Apparatus as defined in claim 1 in which said means for releasably securing said top end of said reinforcement component to a building includes a first bracket having a strap with two ends with one end to be secured to said top end of said reinforcement component and the other end extending toward a building, and which further includes a second bracket having an L-shaped portion with first and second legs forming an "L", one leg of said "L" to be secured to a building and the other leg of said "L" extending toward and in a parallel-adjacent relationship with said other end of said strap portion of said first bracket, each of said other ends having coinciding apertures formed therein to enable said other ends to be fastened together.

13. Apparatus as defined in claim 1 in which said means for releasably securing said top end of said reinforcement component to a building includes a first U-shaped bracket having two sides forming a "U" with a side connector portion secured to said top of said reinforcement component with said "U" surrounding said component with the "U" opening toward a building, and which further includes a second U-shaped bracket also having two sides forming a "U" with a side connector portion to be secured to a building with said "U" opening toward said component and in a position in which said sides of both of said "U's" intermesh, said intermeshed sides having coinciding apertures formed therein to enable said intermeshed sides to be fastened together.

14. Apparatus as defined in claim 1 in which such an overhead door carries a horizontally disposed stiffening rib extending rearwardly therefrom, and in which said means for releasably securing said top end of said reinforcement component includes means for selectively adjusting the distance between said reinforcement component and a stiffening rib carried on the inside of such a door so that said reinforcement component can be adjusted to butt up against such a rib to prevent inward movement of such a door.

15. A kit for use with a building having a wall with a door opening formed therein, a foor, a sectional overhead door carrying a plurality of panel connecting hinges having leaves with knuckles formed thereon with a hollow pin through the knuckles joining the leaves for closing the door opening, and at least one strut having top and bottom ends to be substantially vertically disposed adjacent to the inside of such a door when closed for reinforcing that door against wind damage, unauthorized entry and the like, the kit comprising:

(a) means for releasably securing a bottom end of such a reinforcing strut in a fixed position to a floor inside of and adjacent to a closed sectional overhead door in such a building, (b) means for releasably securing a top end of such a reinforcing strut in a fixed position to such a building above such a closed door, and (c) means for releasably securing at least one of such hinges carried on such a sectional overhead door to such a reinforcing strut to prevent outward and inward movement of such door.

16. A kit as defined in claim 15 in which said means for releasably securing such hinges to a reinforcing strut includes a U-shaped member having two legs, one of said legs to be connected to a reinforcing strut and the other of said legs being formed as a finger portion insertable into a hollow pin of such a hinge.

17. A kit as defined in claims 16 in which said U-shaped member has said one leg formed as a second finger portion which is connected to said first-mentioned finger portion, said second finger portion being insertable into a bore formed in such a reinforcing strut to receive said second finger portion.

18. A kit as defined in claim 15 which further includes means for releasably securing a bottom end of such a strut to a bottom of such a door to prevent inward and outward movement of such a door bottom.

19. A kit as defined in claim 15 which further includes means for releasably securing a top end of such a strut to a top of such a door to prevent inward and outward movement of such a door top.

20. A kit as defined in claim 15 in which said means for releasably securing a bottom end of such a reinforcing strut to a floor includes a pin for connection to and extension downwardly from a bottom end of such a strut, said pin having a length which allows said pin to extend from a bottom end of such a strut enabling insertion of said pin into a bore formed in a floor to receive said pin.

21. A kit as defined in claim 20 which further includes a sleeve for insertion into a bore formed in a floor to receive said pin extending from a bottom of such a strut, whereby the integrity and dimensions of a floor bore are maintained for repeated insertions and withdrawals of said pin.

22. A kit as defined in claim 20 in which said means for releasably securing a bottom end of a reinforcing strut to a floor further includes a U-shaped bracket having upwardly extending sides and a bottom portion connecting said upwardly extending sides which conforms to and receives a bottom of a reinforcing strut, said bottom portion of said U-shaped bracket abutting said pin, said upwardly extending sides of said U-shaped bracket to be positioned on a strut to receive back and forth pressures applied to a strut by such a door.

23. A kit as defined in claim 22 which further includes means for securing said U-shaped bracket and said pin to a strut, whereby said U-shaped bracket and pin stay attached to a strut when a strut is removed from a reinforcing position for storage.

24. A kit as defined in claim 18 in which said means for releasably securing a bottom of such a door to a bottom end of a strut includes a bracket having an L-shaped portion with first and second legs forming an "L", said first leg of said "L" to be secured to a bottom end of a strut and said second leg of said "L" to be secured to a bottom end of such a door.

25. A kit as defined in claim 19 in which said means for releasably securing a top end of such a strut to a top end of such a door includes a bracket having an L-shaped portion with first and second legs forming an "L", said first leg of said "L" to be secured to a top end of a strut while said second leg of said "L" is to be secured to a top of such a door.

26. A kit as defined in claim 15 in which said means for releasably securing a top end of such a strut to a building includes a first bracket having a strap portion having two ends with one end to be secured to a top end of a strut and with the other end extending toward a building, and which further includes a second bracket having an L-shaped portion having first and second legs forming an "L", said first leg of said "L" to be secured to a building with said second leg extending toward and in a parallel-adjacent relationship with said other end of said strap portion of said first bracket, said other end of said first bracket and said second leg of said second bracket having coinciding apertures formed therein to enable them to be releasably secured together.

27. A kit as defined in claim 15 in which said means for releasably securing a top end of such a strut to a building includes a first U-shaped bracket having a connector portion and two sides extending therefrom to form a "U" to be secured to a top end of a strut with said "U" surrounding sides of a strut and opening toward a building, and which further includes a second U-shaped bracket having a connector portion and two sides extending therefrom to form a "U" to be secured to a building with said "U" opening toward such a strut and in a position in which said sides of said first and second U-shaped brackets intermesh, said intermeshed sides having coinciding apertures formed therein to enable said intermeshed sides to be fastened together.

28. A kit as defined in claim 15 in which such an overhead door carries a horizontally disposed stiffening rib extending rearwardly therefrom, and which further includes means for selectively adjusting the distance between a reinforcing strut and a stiffening rib carried on the inside of such a door so that a strut butts up against such a rib to prevent inward movement of such a door.

* * * * *